United States Patent [19]

Sudoh

[11] Patent Number: 4,836,225

[45] Date of Patent: Jun. 6, 1989

[54] SHREDDED TOBACCO LEAF PELLET AND PRODUCTION PROCESS THEREOF

[75] Inventor: Kunio Sudoh, Tokyo, Japan

[73] Assignee: Kowa Display Co., Inc., Tokyo, Japan

[21] Appl. No.: 80,919

[22] Filed: Aug. 3, 1987

[30] Foreign Application Priority Data

Dec. 11, 1986 [JP] Japan ..... 61-293381
Mar. 25, 1987 [JP] Japan ..... 62-069097

[51] Int. Cl.[4] ..... A24B 13/00; A24B 15/18; A24B 15/28

[52] U.S. Cl. ..... 131/352; 131/347; 131/348; 131/355

[58] Field of Search ..... 131/347, 348, 352, 355

[56] References Cited

U.S. PATENT DOCUMENTS 380,590 4/1888 Peabody ..... 131/348
2,158,928 5/1939 Deich ..... 131/348 X
4,497,331 2/1985 Nellen ..... 131/355 X

*Primary Examiner*—V. Millin
*Assistant Examiner*—Joe H. Cheng
*Attorney, Agent, or Firm*—Oblon, Spivak, McClelland, Maier & Neustadt

[57] ABSTRACT

A shredded tobacco leaf pellet is composed of tobacco leaf shreds bound together with a resin binder while retaining air permeability. The shredded tobacco leaf pellet is produced by applying a polyol and a polyisocyanate to tobacco leaf shreds and then reacting the polyol and polyisocyanate to each other, whereby the tobacco leaf shreds are bound together while retaining air permeability. The shredded tobacco leaf pellet may be used to provide a cigarette-like snuff by holding the shredded tobacco leaf pellet within a cigarette-shaped hollow cylindrical member made of paper or a plastic material.

3 Claims, 2 Drawing Sheets

SHREDDED TOBACCO LEAF PELLET AND PRODUCTION PROCESS THEREOF

BACKGROUND OF THE INVENTION (1) Field of the Invention:

This invention relates to a shredded tobacco leaf pellet, a production process thereof and a cigarette-like snuff using the pellet, and more specifically to a shredded tobacco leaf pellet obtained by shaping conventional cigarette shreds (i.e., shredded, cut, pulverized or ground tobacco leaves) with a resin binder while retaining air permeability, a production process thereof and a cigarette-like snuff making use of the pellet. The cigarette-shaped snuff is a smokeless cigarette which does not give unpleasant feeling or adverse influence such as smoke, offensive odor and/or ash to those around its inhaler and moreover does not substantially impair the health of its inhaler himself.

The term "shredded tobacco leaf pellet" as used herein means a pellet of tobacco leaf shreds. The word "pellet" should be interpreted in a broad sense so that the shredded tobacco leaf pellet may not be limited to any particular shape. Similarly, the term "shred" as used herein should not be interpreted to imply any particular shape or size for shredded tobacco leaves. Tobacco leaf shreds may hence be of any shape and any size so long as they can fulfill objects of this invention to be described subsequently.

(2) Description of the Prior Art:

Tobacco has been consumed in great quantity for many years. It is however accompanied by a problem that its smoke, odor, ash and the like give unpleasant feeling to nearby non-smokers. Tobacco is also a potential fire hazard because it always requires lighting. A further problem has come to the surface that the health of smokers is adversely affected by inhalation of carbon monoxide and tar which occur upon combustion of tobacco leaves.

As a method for overcoming the above-mentioned problems of tobacco and still drawing satisfaction from habitual or regular smokers, peppermint pipes and the like have conventionally been known as one kind of snuffs. These peppermint pipes and the like however do not contain inherent and essential components of tobacco and cannot hence give feeling of smoking. For these reasons, they have not been accepted widely.

On the other hand, substitute cigarettes (for example, "Flavor", trade name for substitute cigarettes produced in U.S.A.) have also been known. They are produced by extracting and purifying nicotine which is a principal component of tobacco, causing a suitable carrier to bear nicotine and then inserting and holding in a tip portion of a cigarette-shaped hollow cylinder, so that nicotine can be inhaled little by little upon inhalation.

The above substitute cigarettes do not require lighting and do not give off any smoke. They have hence solved most of the problems of conventional cigarettes, while still giving feeling of smoking very close to conventional cigarettes. They are however insufficient in other trace components, aroma and the like of tobacco. They have hence not been able to substitute fully for conventional cigarettes.

It has hence been desired to develop a smokeless tobacco or cigarette which does not require lighting and can give stimulative or sedative effects similar to conventional tobacco or cigarettes without smoke and ash.

SUMMARY OF THE INVENTION

An object of this invention is therefore to provide a shredded tobacco leaf pellet which can provide feeling of smoking similar to conventional tobacco without smoke, odor and/or ash and moreover does not substantially impair the health of its inhaler himself.

Another object of this invention is to provide a process for the production of such a shredded tobacco leaf pellet.

A further object of this invention is to provide a cigarette-like snuff making use of such a shredded tobacco leaf pellet.

The present inventors have carried out an extensive investigation to meet the above-described long standing desire in the present field of art and also to fulfill the objects of this invention.

In one aspect of this invention, there is thus provided a shredded tobacco leaf pellet which comprises tobacco leaf shreds bound together with a resin binder while retaining air permeability.

In another aspect of this invention, there is also provided a process for the production of a shredded tobacco leaf pellet, which comprises applying a polyol and a polyisocyanate to tobacco leaf shreds and then reacting the polyol and polyisocyanate to each other, whereby the tobacco leaf shreds are bound together while retaining air permeability.

In a further aspect of this invention, there is also provided a cigarette-like snuff which comprises a cigarette-shaped hollow cylindrical member made of paper or a plastic material and the above shredded tobacco leaf pellet. The pellet is inserted and held in the hollow cylindrical member.

According to the present invention, the shredded tobacco leaf pellet is formed with air permeability. By assembling the shredded tobacco leaf pellet into a cigarette-like shape and inhaling same, its inhaler can enjoy the same effects as those available from smoking a real cigarette without need for lighting the pellet, without producing smoke and ash, and without inhaling any tar or carbon dioxide.

Use of the shredded tobacco leaf pellet does not require any fire, so that neither smoke nor ash is produced obviously, the surrounding environment is not contaminated and nearby non-smokers are not annoyed. The shredded tobacco leaf pellet can thus be inhaled in a vehicle as desired. Owing to the prevention of inhalation of tar which is a principal toxic substance of tobacco, carbon monoxide and the like for the same reasons, the health of the inhalers is not impaired substantially.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENTS

Figure 1:
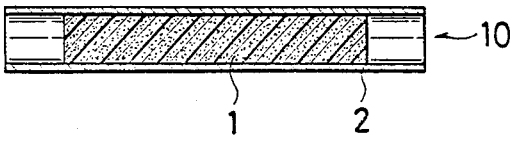
FIG. 1 is a longitudinal cross-sectional view of a snuff according to one embodiment of this invention, which makes use of a shredded tobacco leaf pellet of this invention.
Figure 2:
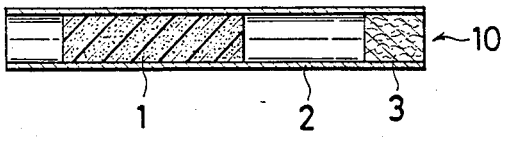
FIG. 2 is a longitudinal cross-sectional view of a snuff according to another embodiment of this invention, which also makes use of a shredded tobacco leaf pellet of this invention.
Figure 3:
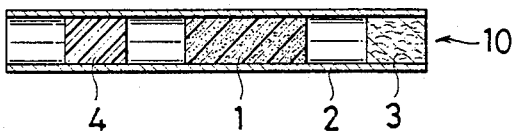
FIG. 3 is a longitudinal cross-sectional view of a snuff according to a further embodiment of this invention, which also makes use of a shredded tobacco leaf pellet of this invention.

As depicted in FIGS. 1–5, the shredded tobacco leaf pellet of this invention designated at numeral 1 has been obtained by shaping tobacco leaf shreds with a resin binder while retaining air permeability. By assembling the shredded tobacco leaf pellet 1 as shown by way of example in any one of the accompanying drawings, the pellet 1 can be used in the same manner as conventional cigarettes without lighting same and allows an inhaler to feel as if he is smoking a real cigarette. Namely, an outer cylindrical enclosure 2 made of paper or a plastic material may be provided around the shredded tobacco leaf pellet as depicted in FIG. 1. As shown in FIG. 2, a filter tip 3 which is of the same type as those employed in conventional cigarettes may be provided as illustrated in FIG. 2. As depicted in FIGS 3. and 4, an air-permeable member 4 impregnated or coated with nicotine may also be provided in combination at a desired position. As a still further alternative, the outer cylindrical enclosure 2 may be divided into two parts 2',2''. One of the parts, i.e., the part 2' is provided with a means 5 for holding the shredded tobacco leaf pellet 1 so that the shredded tobacco leaf pellet 1 is held in place within the part 2'. The part 2' with the pellet 1 held therein is releasably fit with the part 2'', thereby permitting replacement of the pellet 1 as needed.

Figure 4:
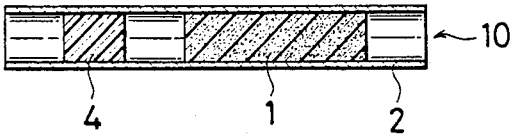
FIG. 4 is a longitudinal cross-sectional view of a snuff according to a still further embodiment of this invention, which also makes use of a shredded tobacco leaf pellet of this invention.

In the embodiments shown in FIGS. 3 and 4 respectively, it is preferable to arrange the nicotine impregnated or coated member 4 at a position somewhat set back inwardly from the free end of the outer cylindrical enclosure 2 so that the nicotine impregnated or coated member 4 is not brought into contact with the lips or tongue of an inhaler even if the inhaler accidentally takes the snuff on the side of the nicotine impregnated or coated member 4 in his mouth.

Figure 5:
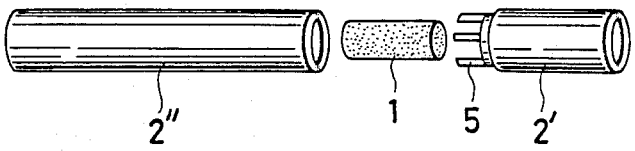
FIG. 5 is an exploded perspective view of a snuff according to a still further embodiment of this invention, in which a shredded tobacco leaf pellet is held in an outer cylindrical enclosure formed of two parts fitted releasably with each other.

Although the snuffs of FIGS. 1, 2 and 5 can allow their inhalers to sense the taste and aroma of tobacco leaves, the inhalers cannot take nicotine, the principal component of tobacco, to sufficient extents from the shredded tobacco leaf pellets 1 alone. It is hence preferable to add a suitable amount of nicotine in the shredded tobacco leaf pellet 1 either during or after the production of the pellet 1. In the case of the embodiments shown in FIGS. 3 and 4, nicotine may optionally be incorporated in the shredded tobacco leaf pellets 1.

In order to prevent the shredded tobacco leaf pellet 1 impregnated or coated with nicotine from being brought into contact with the lips or tongue, it is also preferable to provide the filter tip 3 at one end or to leave some space in an end portion of the outer cylindrical member 2 in these cases, as shown in FIGS. 1 to 5. In each of the illustrated embodiments, one or more other flavorings and the like may be mixed upon forming tobacco leaf shreds into the pellet 1.

As has been described above, it is the principal feature of the shredded tobacco leaf pellet 1 of this invention that tobacco leaf shreds has been shaped with a resin binder while retaining air permeability. Therefore, this feature will hereinafter be described more specifically.

For the following reasons, tobacco leaf shreds are shaped with the resin binder while retaining air permeability. Formation of tobacco leaf shreds into a cylindrical shape with a sheet of paper like conventional cigarettes is disadvantageous from the standpoint of production process and when broken or otherwise damaged, tobacco leaf shreds may fly around and make the surrondings dirty. Prevention of such inconvenience is also intended. Even if the cigarette is not broken or otherwise damaged, tobacco leaf shreds may fall out of its lighting tip or mouth-held tip. This in certainly unsanitary and moreover gives unpleasant feeling to the user. It is also intended to solve these drawbacks.

The shredded tobacco leaf pellet of this invention has been formed with air permeability in order to facilitate the inhalation of aroma and trace components of tobacco, which are given off from tobacco leaf shreds.

Tobacco leaves useful in the practice of this invention may be any shredded tobacco leaves which have conventionally been used in cigarettes and pipe tobacco. The degree of shredding of the tobacco leaf shreds may be equal to that of conventional tobacco leaf shreds. Any conventional tobacco leaf shreds known to date may be used accordingly.

No particular limitation is imposed on the resin binder which is used to shape the tobacco leaf shreds. Any resin binder may be used so long as it can solidify tobacco leaf shreds into a desired shape while retaining air permeability.

Natural and synthetic resin binders may be used as desired, for example, starch, casein, gelatin, gum arabic, polyvinyl alcohol, polyacrylamide, carboxymethylcellulose, polyvinylpyrrolidone, polyacrylic acids and water-soluble salts thereof, polyvinyl acetate, vinyl acetate-acrylic ester polymers, polyacrylic esters, epoxy resins, phenol resins, melamine resins, alkyd resins, natural rubber, synthetic rubbers, polyurethane rubber, etc.

Such a resin binder may be used, for example, in the following manner. The resin binder is provided in the form of a melt or an aqueous solution, emulsion, latex or organic solvent solution in which the resin binder is contained at a concentration of 1–50 wt. %. The resin binder is then absorbed in tobacco leaf shreds to such extent that the amount of the resin binder reaches about 1–100 parts by weight per 100 parts by weight of the tobacco leaf shreds, so that the tobacco leaf shreds are imparted with stickiness and are then formed into a desired shape, followed by drying.

In a process particularly preferable in the practice of this invention, a polyol and polyisocyanate which are raw materials for a polyurethane resin are used and the polyurethane resin is formed concurrently with the shaping of tobacco leaf shreds. According to this process, the polyol and polyisocyanate are generally liquid at room temperature. It is hence unnecessary to use water, an organic solvent or the like, which has a potential danger of altering the quality of the tobacco leaf shreds, upon allowing the tobacco leaf shreds to absorb them. It is therefore unnecessary to dry off such a solvent. Use of such polyol and polyisocyanate are therefore preferable from the viewpoint of not only the quality of a final product to be obtained but also its production process.

The process includes, for example, the following preferred embodiments.

(1) Tobacco leaf shreds are impregnated or coated with a polyol and polyisocynate simultaneously. Either before the initiation of a reaction of the thus-impregnated or coated components or in an initial stage of the reaction, the impregnated or coated tobacco leaf shreds are formed into a desired shape and the reaction is allowed to proceed to bind the tobacco leaf shreds while retaining air permeability.

(2) After impregnating or coating tobacco leaf shreds with either one of a polyol and polyisocyanate, the resultant tobacco leaf shreds are either impregnated or coated with the other one of the polyol and polyisocyanate, followed by shaping in the same manner as in the embodiment (1).

(3) A portion of tobacco leaf shreds are impregnated or coated in advance with either one of a polyol and polyisocyanate. On the side, another portion of tobacco leaf shreds is impregnated or coated with the other one of the polyol and polyisocyanate. These portions of tobacco leaf shreds, which have been impregnated or coated, are mixed together to react the polyol and polyisocyanate to shape them in the same manner as described above.

The polyol useful in the practice of the process according to the present invention is a polyol which is used routinely in conventionally-known processes for the production of polyurethane resins. Illustrative examples of the polyol may include diols such as ethylene glycol, propylene glycol, diethylene glycol, 1,4-butanediol and 1,6-hexanediol; polyhydric alcohols such as glycerin, trimethylolpropane, diglycerin and pentaerythritol; polyether polyols obtained by polymerizing alkylene oxides such as ethylene oxide and propylene oxide by using as initiators polyols such as those mentioned above; polyester polyols obtained by polymerizing polyols such as those mentioned above with polybasic acids; polyether polyester polyols formed of polyether polyols such as those mentioned above and polybasic acids; various saccharides such as cellulose; low molecular polyvinyl alcohols; partial saponification products of polyvinyl acetate; hydroxyl-modified acrylic resins; and mixtures thereof.

The above polyols may be used either singly or in combination. In order to impart sufficient strength and air permeability with a small amount of the resulting polyurethane resin, it is preferable to use a polyol, the functionality of which is at least 3, in an amount of 5 wt. % or more, preferably, 10 wt. % or more.

As such a polyol, it is preferable to use a polyol which is liquid at room temperature. When a polyol not liquid at room temperature is used, it is preferable to mix it with another polyol which is liquid at room temperature so that the former is used in a liquid form. As an alternative, a small amount of an organic solvent may be used in combination.

It is also possible to incorporate in advance a small amount of water as a foaming agent, a small amount of nicotine and/or one or more of various flavorings and additives for tobacco in such a polyol. For example, inclusion of water in a polyol to an amount of about 1–10 wt. % based on the resultant mixture leads to the formation of a foamable polyurethane resin. It is hence possible to obtain a shredded tobacco leaf pellet of high air permeability and strength by a small amount of a polyurethane resin. Inclusion of water is therefore preferable.

Tobacco leaf shreds may preferably be impregnated or coated with the polyol to such an extent that the tobacco leaf shreds with the polyol absorbed therein gives somewhat wet feeling, for example, in an amount of about 10–100 parts by weight per 100 parts by weight of the tobacco leaf shreds. If the proportion of the polyol is too low, the binding of the tobacco leaf shreds is insufficient so that pellets of sufficient strength can handly be obtained. It is hence not preferable to use the polyol in such a small amount. Any excess proportions are not preferable either, because the resulting shredded tobacco leaf pellets have lower air permeability.

Similar to the above-described polyol, the polyisocyanate useful in the practice of this invention is also a polyisocyanate which has been employed commonly in the production of polyurethane resins. As exemplary polyisocyanates, may be mentioned 4,4$\alpha$ -diphenylmethane diisocyanate (MDI), hydrogenated MDI, isophorone diisocyanate, 1,3-xylylene diisocyanate, 1,4-xylylene diisocyanate, 2,4-tolylene diisocyanate, 2,6-tolylene diisocyanate, 1,5-naphthaline diisocyanate, m-phenylene diisocyanate, p-phenylene diisocyanate, etc. In addition, it is of course possible to use urethane prepolymers and the like, which are obtained by reacting these organic polyisocyanates with low molecular polyols or polyamines in such a way that the polyisocyanates become terminal isocyanates.

Many of above-exemplified polyisocyanates are liquid at room temperature. A polyisocyanate which is not not liquid at room temperature may be used preferably by somewhat heating it into a liquid form, mixing it with a liquid polyisocyanate, or reacting it with a liquid polyol out of the above-described polyols at an NCO-excessive ratio to use it as a liquid NCO-terminated prepolymer. It is also feasible to used a small amount of an organic solvent in combination.

The amount of such a polyisocyanate varies in accordance with the amount of the above-described polyol. The NCO/OH ratio of the polyisocyanate to the polyol may be within a range of from about 2/1 to about $\frac{1}{2}$, preferably, within a range of from about 1.2/1 to 1/1.2, more preferably, about 1/1. In terms of weight, it is preferable to use 5–50 parts by weight of the polyisocyanate per 100 parts by weight of tobacco leaf shreds.

Using such polyol and polyisocyanate as those described above, tobacco leaf shreds are bound together. In the embodiment (3) of the process according to this invention, tobacco leaf shreds are impregnated or coated with a polyol and polyisocyanate simultaneously. The reaction between the polyol and polyisocyanate thus begins concurrently with their impregnation or coating. It is hence preferable to impregnate or coat tobacco leaf shreds promptly and then to form them into pellets in a short period of time. Such inconvenience can however be overcome by using a block polyisocyanate which has been rendered non-reactive at room temperature but reactive at temperatures above a given temperature, whereby the tobacco leaf shreds are impregnated or coated sufficiently with the polyol and polyisocyanate, formed into a desired shape, for example, by using a mold or the like, and then subjected to a heat treatment so that the objects of this invention are achieved.

The embodiment (2) of the process is a modification of the embodiment (1). The embodiment (2) is preferable, because the embodiment (2) permits a large stock of tobacco leaf shreds impregnated or coated beforehand with the polyol or polyisocyanate.

The embodiment (3) of the process is in turn a modification of the embodiment (2). In this process, tobacco leaf shreds impregnated or coated with the polyol and tobacco leaf shreds impregnated or coated with the polyisocyanate are prepared separately. They are stable when they remain separate from each other. They can thus be stocked in large volumes. This embodiment is preferable, because shredded tobacco leaf pellets may be provided as many as needed by mixing them as needed. Heating is not particularly required upon conducting such shaping processes as mentioned above. The reaction between the polyol and polyisocyanate may however be accelerated under heat.

The shredded tobacco leaf pellet obtained in the above-described manner may take any shape and no particular limitation is therefore imposed on its shape. For example, tobacco leaf shreds may be formed into a large block-like shape. It may then be machined into a desired shape, for example, into a cylindrical shape such as that depicted in FIG. 1 or into any other shapes. As an alternative, a mold having a cylindrical shape such as that shown in FIG. 1 or a mold of another shape is provided and tobacco leaf shreds are then bound within the mold to obtain a shredded tobacco leaf pellet conforming in shape with the mold.

The shredded tobacco leaf pellet 1 of this invention can be obtained as described above. It is then assembled into a cigarette-like shape as illustrated in FIG. 1 or FIG. 2. The taste and aroma of tobacco can be sensed by inhaling it through the mouth. Nicotine may not be sufficient in this form, so that the snuff of FIG. 1 or 2 may be insufficient as a cigarette substitute in some instances. It is hence preferable to add nicotine in the course of the above formation or after the formation. Nicotine may be mixed with the tobacco leaf shreds and/or resin binder (i.e., polyol and polyisocyanate) before the formation. It may also be mixed in the course of the formation. As a further alternative, it may be caused to penetrate as an alcohol solution or the like into the pellet after the formation of the pellet. It is enough to mix nicotine in an amount of about 0.01–10 g per 100 g of tobacco leaf shreds. It is also possible to incorporate one or more of various flavorings other than nicotine at the same time.

As a still further alternative, a nicotine-containing pellet 4 is prepared separately instead of mixing nicotine in the shredded tobacco leaf pellet 1 and is used in combination with the shredded tobacco leaf pellet 1 in the outer cylindrical enclosure 2 as shown in FIG. 3 and FIG. 4.

When nicotine and one or more flavorings are mixed in the shredded tobacco leaf pellet 1 of this invention or the nicotine-containing pellet 4 is used in combination with the shredded tobacco leaf pellet 1, it is possible to inhale both nicotine and other aroma of tobacco simultaneously so that the resulting snuff can show sufficient effects as a substitute for conventional cigarettes.

The present invention will hereinafter be described more specifically by the following Examples, in which all designations of "part" or "parts" and "%" means part or parts by weight and wt. % unless otherwise specifically indicated.

EXAMPLE 1

To 100 parts of tobacco leaf shreds which had been obtained by pulverizing tobacco leaves, were added 40 parts of a 1:1:1:0.1 mixture (by weight ratio) of ethylene glycol, polypropylene glycol, glycerin and a 10% alcohol solution of nicotine. The resulting mixture was stirred for about 1 hour to impregnate and coat the tobacco leaf shreds thoroughly with the polyols. The thus-impregnated and coated tobacco leaf shreds had somewhat wet feeling. The thus-impregnated and coated tobacco leaf shreds were then added with 30 parts of a mixed tolylene diisocyanate solution, followed by their mixing for 10 minutes so as to impregnate and coat the tobacco leaf shreds. The resultant impregnated and coated tobacco leaf shreds were filled in a cubic container and left over, thereby obtaining a shredded tobacco leaf pellet of this invention. The pellet was cut into a cylindrical pellet having a diameter of 7.2 mm and a length of 2 cm, so that a shredded tobacco leaf pellet 1 of this invention in the form of a cigarette was obtained.

The above pellet was pushed into a cylindrical member, which was 7.2 mm in inner diameter and 8.3 cm in length and was made of a sheet of paper, to a central part of the cylindrical member. Inserted in a tip portion of the cylindrical member was an air-permeable resin pellet impregnated and coated with purified nicotine and having a diameter of 7.2 mm and a length of 5 mm, thereby obtaining a cigarette-like snuff.

When the snuff was inhaled without lighting same, feeling of smoking similar to that available from conventional cigarettes was obtained.

EXAMPLE 2

Added to 100 parts of tobacco leaf shreds were 50 parts of a 1:1:1:0.1:0.001 mixture (by weight ratio) of propylene glycol, polyethylene glycol, trimethylol propane, a 20% alcohol solution of nicotine and a flavoring. The resulting mixture was stirred for about 1 hour to impregnate and coat the tobacco leaf shreds with the polyols.

On the side, 30 parts of hydrogenated MDI were added to 100 parts of tobacco leaf shreds, followed by mixing for about 30 minutes to impregnate and coat the tobacco leaf shreds thoroughly with the polyisocyanate.

While mixing at a weight ratio of 1:1 the above polyol-impregnated and coated tobacco leaf shreds and polyisocyanate-impregnated and coated tobacco leaf shreds, they were rolled into a cylindrical shape having a diameter of 7.2 mm between two boards so as to obtain a shredded tobacco leaf pellet of this invention. The shredded tobacco leaf pellet was covered with a sheet of paper and was cut into a length of 8.3 cm. When it was inhaled as a snuff (without lighting), feeling of smoking not different practically from that available from usual cigarettes was obtained.

EXAMPLE 3

Added to 100 parts of tobacco leaf shreds were 30 parts of a 1:1:1:0.1:0.001 mixture (by weight ratio) of propylene glycol, polyester polyol, glycerin, a 20% alcohol solution of nicotine and a flavoring. The resulting mixture was stirred for about 1 hour to impregnate and coat the tobacco leaf shreds thoroughly with the polyols.

The thus-impregnated and coated tobacco leaf shreds were then added with 20 parts of a cresol-stabilized addition product of 3 moles of 2,4-tolylene diisocyanate and 1 mole of trimethylol propane, followed by their thorough mixing for aboout 30 minutes so as to impregnate and coat the tobacco leaf shreds with the polyisocyanate.

The wet tobacco leaf shreds were filled in a number of cylinders having an inner diameter of 7.2 mm. After a heat treatment at 120° C. for 1 hour, the resultant shredded tobacco leaf pellets were taken out of the cylinders. They were covered by sheets of paper and cut into a length of 8.3 cm. When they were inhaled as snuffs without lighting, feeling of smoking not different practically from that available from usual cigarettes was obtained.

EXAMPLE 4

Fifty parts of tobacco leaf shreds, which had been obtained by pulverizing tobacco leaves, were added to 100 parts of a polyol solution for a polyurethane foam. After thorough mixing, 15 parts of a polyisocyanate solution were added to induce foaming so that a foam having an expansion ratio of 5 was obtained. The foam was cut into a cylindrical pellet the diameter and length of which were 7.2 mm and 2 cm respectively, thereby obtaining a shredded tobacco leaf pellet 1 of this invention.

The above pellet 1 was then pushed into a cylindrical member, which was 7.2 mm in inner diameter and 8.3 cm in length and was made of a sheet of paper, to a central part of the cylindrical member. Inserted in a tip portion of the cylindrical member was an air-permeable resin pellet 4 impregnated with purified nicotine and having a diameter of 7.2 mm and a length of 5 mm.

When the snuff was inhaled without lighting same, feeling of smoking similar to that available from conventional cigarettes was obtained.

EXAMPLE 5

Soaked fully with 40 parts of a 10% aqueous solution of starch were 100 parts of tobacco leaf shreds. The thus-soaked tobacco leaf shreds were then rolled into a cylindrical shape having a diameter of 7.0 mm between two boards. Water was then allowed to evaporate fully so that the resultant roll was dried. The roll was thereafter immersed in a 5% solution of nicotine in ethanol. The roll was pulled out of the solution and ethanol was allowed to evaporate, thereby drying the roll and obtaining a shredded tobacco leaf pellet 1 of this invention. The shredded tobacco leaf pellet 1 was then covered with a sheet of paper, cut into a length of 8.3 cm and then inhaled as a snuff (without lighting). Feeling of smoking not different practically from that available from usual cigarettes was obtained.

What is claimed is:

1. An air permeable shredded tobacco leaf pellet for inhaling without lighting, comprising:

tobacco leaf shreds bound together with a resin binder selected from the group consisting of starch, casein, gelatin, gum arabic, polyvinyl alcohol, polyacrylamide, polyvinylpyrrolidone, a polyacrylic acid, a water-soluble salt thereof, polyvinyl acetate, vinyl acetate-acrylic ester polymer, a polyacrylic ester, an epoxy resin, a phenol resin, a melamine resin, an alkyd resin, natural rubber, synthetic rubber and polyurethane rubber, and impregnated with nicotine.

2. A cigarette-like snuff comprising:

a cigarette-shaped hollow cylinder formed of two parts, one of which is releasably fitted with the other part, and a pellet of an air permeable shredded tobacco leaf pellet for inhaling without lighting, said tobacco leaf shreds being bound together with a resin binder and impregnated with nicotine and being inserted in said cylinder and retained in position within the cylinder by said releasably fitted part which is equipped with a means of holding said pellet in position within the cylinder.

3. The air permeable shredded tobacco leaf pellet of claim 2, wherein said resin binder is a member selected from the group consisting of starch, casein, gelatin, gum arabic, polyvinyl alcohol, polyacrylamide, polyvinylpyrrolidone, a polyacrylic acid, a water-soluble salt thereof, polyvinyl acetate, vinyl acetate-acrylic ester polymer, a polyacrylic ester, an epoxy resin, a phenol resin, a melamine resin, an alkyd resin, natural rubber, synthetic rubber and polyurethane rubber.

* * * * *